US007486864B2

(12) United States Patent
Diatzikis

(10) Patent No.: US 7,486,864 B2
(45) Date of Patent: Feb. 3, 2009

(54) MONITORING SYSTEM FOR TURBINE ENGINE

(75) Inventor: Evangelos V. Diatzikis, Chuluota, FL (US)

(73) Assignee: Siemens Energy, Inc., Orlando, FL (US)

( * ) Notice: Subject to any disclaimer, the term of this patent is extended or adjusted under 35 U.S.C. 154(b) by 61 days.

(21) Appl. No.: 11/784,152

(22) Filed: Apr. 5, 2007

(65) Prior Publication Data

US 2008/0245980 A1 Oct. 9, 2008

(51) Int. Cl.
*G02B 6/02* (2006.01)

(52) U.S. Cl. ..... 385/123

(58) Field of Classification Search ..... 385/144; 600/108; 374/131
See application file for complete search history.

(56) References Cited

U.S. PATENT DOCUMENTS 5,366,290 A 11/1994 Mayer et al.
5,662,418 A 9/1997 Deak et al.
6,109,783 A * 8/2000 Dobler et al. ..... 374/131
6,128,079 A 10/2000 McCloskey et al.
6,364,524 B1 4/2002 Markham
6,879,386 B2 4/2005 Shurgalin et al.
6,993,240 B2 1/2006 Kashihara et al.
2004/0208470 A1 * 10/2004 Janney et al. ..... 385/144
2005/0169590 A1 8/2005 Alkeskjold
2005/0185908 A1 8/2005 Roberts et al.
2005/0190814 A1 9/2005 Liu
2005/0198967 A1 9/2005 Subramanian
2006/0052661 A1 * 3/2006 Gannot et al. ..... 600/108

FOREIGN PATENT DOCUMENTS

EP 0898158 A2 2/1999

* cited by examiner

*Primary Examiner*—Quyen P Leung

(57) ABSTRACT

A monitoring system for a gas turbine or other elevated temperature environment is provided. The system has one or more photonic crystal fibers for capturing and transmitting light to an imaging camera for generation of an image. The photonic crystal fibers can be formed from a sapphire cladding. The photonic crystal fibers can be band gap fibers. The photonic crystal fibers can be arranged in a bundle, including an array or a linear bundle.

19 Claims, 5 Drawing Sheets

MONITORING SYSTEM FOR TURBINE ENGINE

FIELD OF THE INVENTION

This invention is directed generally to monitoring devices, and more particularly to monitoring devices that use fiber optics for imaging of turbine engines at operating load.

BACKGROUND

Typically, gas turbine engines include a compressor for compressing air, a combustor for mixing the compressed air with fuel and igniting the mixture, and a blade assembly for producing power. Combustors often operate at high temperatures that may exceed 2,500 degrees Fahrenheit. The high temperatures create a high stress environment under which components of the turbine engines must operate.

Monitoring of the turbine engine components in this high stress environment is difficult due to the temperature that the monitoring equipment must withstand and the high speed and vibrations that the monitoring equipment must endure and still provide data. For instance, monitoring of a gas turbine through use of imaging that requires lenses is difficult because the lenses act as a thermal target and become opaque to transmission of optical radiation. Fiber optic endoscopes or fiber probes use typical telecommunications optical fiber to conduit light from the object or component, but are opaque to the infrared wavelengths and thus are unsuited for use in a turbine engine environment.

Thus, a need exists for a device for monitoring of gas turbine engine components that can operate effectively in a high stress environment including elevated temperatures.

SUMMARY OF THE INVENTION

The invention is directed to monitoring of environments that are subjected to elevated temperatures, such as gas turbines. Photonic crystal fibers can be used to capture light in an area of interest and guide the light to a processor for the generation of an image.

In one aspect of the invention, a system for monitoring an area of interest in a gas turbine is provided. The system can comprise at least one photonic crystal fiber having an imaging end and a processing end; an imaging camera operably connected to the processing end of the at least one photonic crystal fiber; and an imaging processor operably connected to the imaging camera. The photonic crystal fiber can comprise a sapphire cladding and defines a hollow core. The imaging end of the at least one photonic crystal fiber can capture light in the area of interest and guides the light to the imaging camera. The processor can generate an image based on the light.

In another aspect, a monitoring system for an environment having an elevated temperature is provided. The monitoring system can comprise a bundle of photonic crystal fibers having an imaging end and a processing end, with each of the photonic crystal fibers having a cladding comprising a lattice of sapphire capillaries; an imaging camera operably connected to the processing end of the bundle of photonic crystal fibers; and an imaging processor operably connected to the imaging camera. The lattice of sapphire capillaries can have a microstructure that allows the photonic crystal fibers to capture light with a wavelength of between 3 to 12 μm. The photonic crystal fibers can guide the light to the imaging camera. The processor can generate an image based on the light.

In yet another aspect, a method of monitoring a gas turbine is provided. The method can include, but is not limited to, the steps of providing at least one photonic crystal fiber having a hollow core, an imaging end and a processing end; positioning the imaging end in proximity to an area of interest of the gas turbine; operably connecting the processing end to an imaging camera; capturing light with the imaging end; guiding the light through the at least one photonic crystal fiber to the imaging camera; and converting the light into an image with an image processor.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Embodiments of the invention are directed to a monitoring system using a photonic crystal fiber waveguide for imaging of an area of interest in various environments, particularly confined environments with extremely high temperatures. Aspects of the invention will be explained in connection with the photonic crystal fiber system imaging a gas turbine, but the detailed description is intended only as exemplary. Embodiments of the invention are shown in FIGS. 1-7, but the present invention is not limited to the illustrated structure or application.

The area of interest for imaging refers to any region where viewing or monitoring is desired. For example, an interface between a vane and a combustion chamber in an annular combustor of a gas turbine could be an area of interest. The present disclosure contemplates other areas of interests, preferably those areas subject to extremely high temperatures, and can include both moving and non-moving components, as well as confined and open spaces.

The present disclosure is described with respect to an area of interest in a gas turbine. However, it should be understood that the exemplary embodiments described herein have applications in other environments including steam turbines, electric generators, air or gas compressors, auxiliary power plants, and the like. Additionally, other types of high temperature conditions that can be monitored in the context of use within a combustion turbine with the present disclosure include cracked or broken components, as well as combustion flame characteristics.

One skilled in the art may find additional applications for the apparatus, processes, systems, components, configurations, methods and applications disclosed herein. For example, the claimed invention can have application in the field of geology, monitoring pockets exposed to high temperatures in the earth's subsurface. Further, the claimed invention also can have application in the field of fire rescue where monitoring by viewing a confined space in a burning, or recently burned, structure is necessary.

Figure 1:
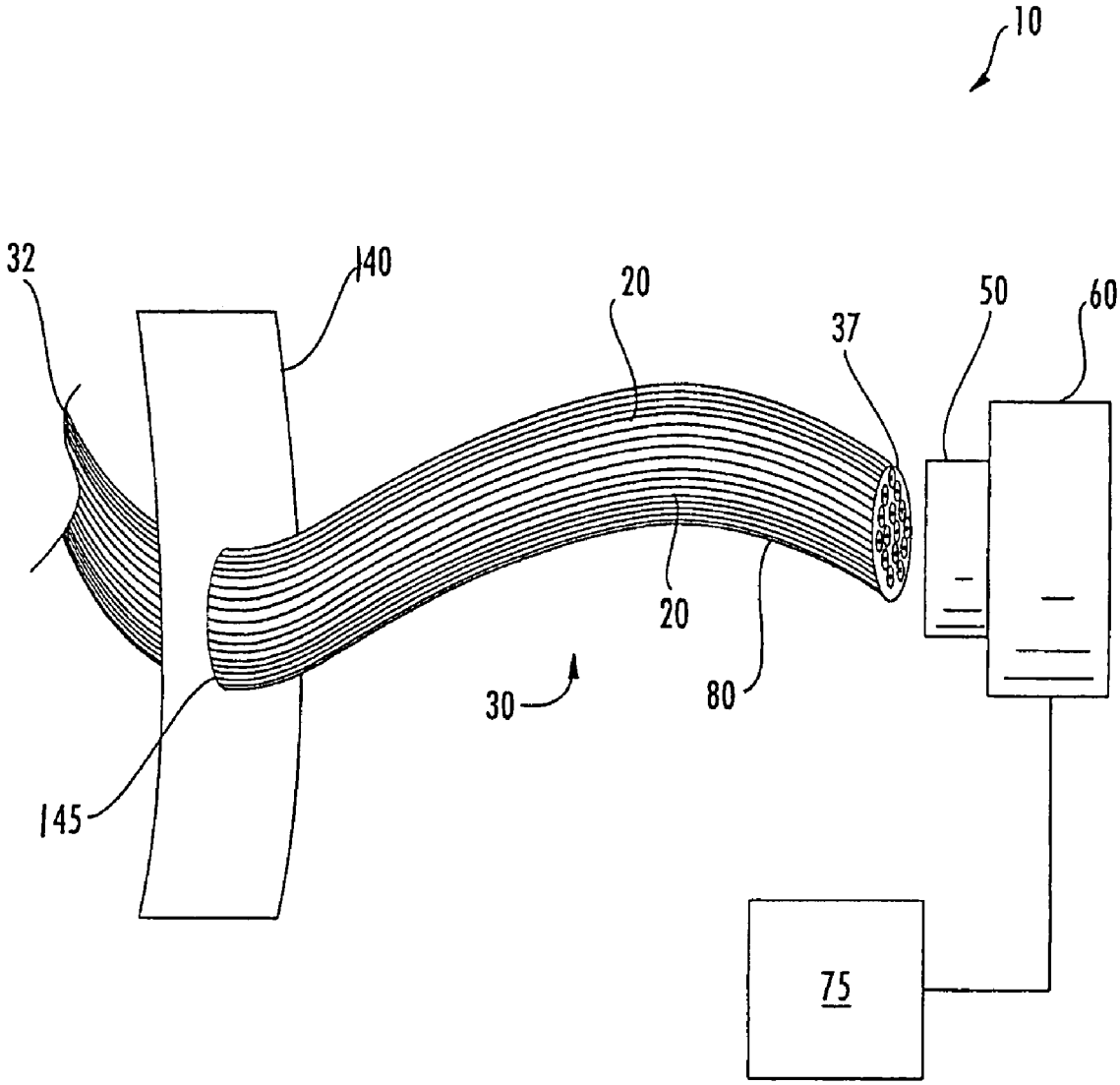
FIG. 1 is a schematic representation of an exemplary embodiment of a monitoring system in accordance with the invention.
Figure 2:
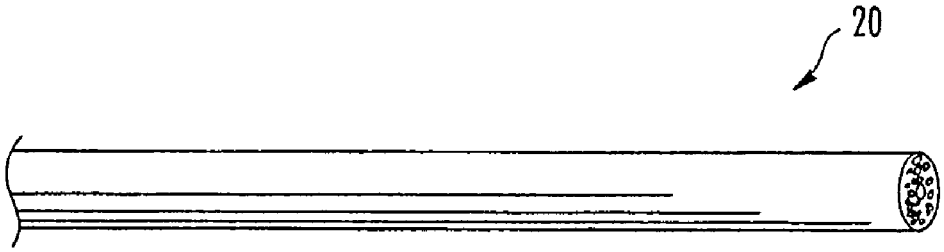
FIG. 2 is a perspective view of a single photonic crystal fiber of the system of FIG. 1.
Figure 3:
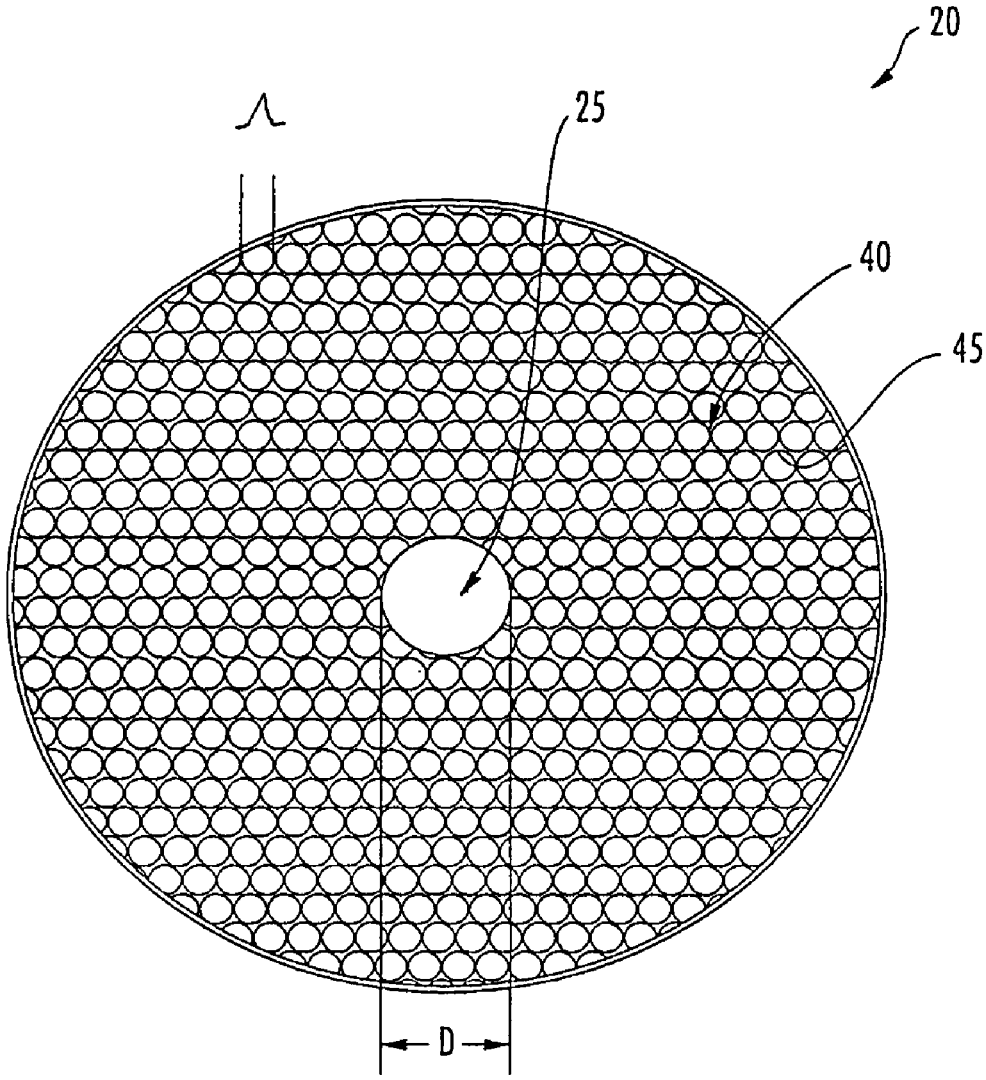
FIG. 3 is a cross-sectional view of the fiber of FIG. 2.

Referring to FIGS. 1-3, a monitoring system is shown and generally represented by reference numeral 10. Monitoring system 10 can have a plurality of photonic crystal fibers 20 which are arranged in a bundle 30. However, the present disclosure contemplates system 10 utilizing a single photonic crystal fiber 20, where the area of interest can be monitored through imaging by a single fiber.

Each of the photonic crystal fibers 20 can have a hollow core 25 surrounded by a glass cladding 40. In the exemplary embodiment of system 10, the photonic crystal fibers 20 can be photonic band gap fibers having a cladding 40 with glass air-filled capillaries 45. Each of the photonic crystals of the fibers 20 can be periodically structured electromagnetic media that have photonic band gaps. The band gaps are ranges of frequency in which light cannot propagate through the structure of the cladding 40. A period Λ of the lattice or structure of the cladding 40 can be chosen to be proportional to the wavelength of light in the band gap from which the image will be formed. Intentionally introduced defects in the photonic crystals can give rise to localized electromagnetic states, e.g., linear waveguides and point-like cavities. Each of the photonic crystal fibers 20 can define an optical insulator, which can confine light around sharp bends, in lower-index media, and/or within wavelength-scale cavities so that an image can be formed from the light.

The preferred embodiment of system 10 can use photonic crystal fibers 20 that are band gap fibers. However, the present disclosure contemplates the use of other types of photonic crystal fibers for capturing and guiding the light from the area of interest, including photonic crystal holey fibers, photonic crystal hole-assisted fibers and photonic crystal Bragg fibers. The present disclosure also contemplates using a combination of photonic crystal band gap fibers, photonic crystal holey fibers, photonic crystal hole-assisted fibers and photonic crystal Bragg fibers in a bundle 30. In one embodiment, various other fibers or other structures can be included in the bundle 30 along with the one or more photonic crystal fibers 20, such as to provide strength to the bundle or to improve the imaging capability.

Each of the hollow cores 25 of the photonic crystal fibers 20 can be filled with air. However, the present disclosure contemplates the use of another medium within the hollow core 25, including selectively introducing a medium into the hollow core, such as a gas. The surrounding glass cladding material can be chosen so that the bundle 30 can survive extremely high temperatures. In a preferred embodiment, the glass cladding 40 can comprise sapphire, which has an operating temperature of greater than 1200° C. and can withstand the turbine environment. The photonic crystal fiber 20 can be formed with the sapphire cladding 40 along all or a portion of the length of the fiber, such as along only the end portion of the fiber that is likely to be exposed to elevated temperatures.

In one embodiment, the sapphire cladding 40 can be positioned along only the imaging end portion of the photonic crystal fiber 20 and can be connected to the remaining portion of the fiber, which comprises a different cladding material, (e.g., silica), through glass solder or other connection techniques or structures. However, to facilitate manufacture of the photonic crystal fiber 20, as well as to provide flexibility in the application of the fiber to its monitoring environment, e.g., allowing for various lengths of the fiber to be exposed to inside of the gas turbine, the fiber can be formed from the sapphire cladding 40 along its entire length.

The forming of the photonic crystal fibers 20, such as fibers with sapphire cladding 40, can be accomplished by various techniques, including a stack-and-draw process. In one exemplary process, a support tube can be filled with a plurality of sapphire tubes and rods for forming the cladding 40 in the desired configuration. A core space can be provided for forming the hollow core 25 at the center axis position to obtain a preform. The preform is then thinned by heating and drawing, such as through the use of a high-temperature drawing tower. The resulting lattice microstructure of sapphire capillaries 45 which forms the cladding 40 can maintain the desired configuration previously provided in the preform. The cladding 40 can then be coated with a protective coating or jacket to form the photonic crystal fiber 20 and bundled with other fibers. Other techniques for forming the photonic crystal fibers 20 can also be utilized, including a two-step process of fusion and drawing.

Monitoring system 10 can have fibers 20 arranged in the bundle 30 to form a light guide for imaging the area of interest of a turbine 140. The bundle 30 can have an imaging end 32 that can be inserted into the turbine 140, such as through an opening or port 145, and positioned in proximity to the location to be imaged. Connection structures or techniques (not shown) can be used to secure the bundle 30 with respect to the port 145 or other portion of the turbine 140. The processing end 37 of the bundle 30 can be connected to an imaging camera 50, such as, for example, an IR imaging camera or a focal plane array imager. In one embodiment, the period Λ of cladding 40 can be chosen so that the bundle 30 transmits infrared wavelengths (e.g., 3-12 μm).

As shown more clearly in FIG. 3, in one embodiment the photonic crystal fiber 20 can have a microstructure lattice of sapphire capillaries 45 formed with a period Λ of 5 μm. The hollow core 25 can be filled with air and can have a diameter D of 13 μm. The present disclosure contemplates the use of other periods Λ and/or other diameters D that allow for capturing of light and guiding the light to the imaging camera 50 for generation of an image of the area of interest.

System 10 is described in one exemplary embodiment as having a photonic crystal fiber 20 having a uniform microstructure lattice of cladding 40 for capturing light in a desired wavelength. The present disclosure also contemplates the use of other cladding (e.g., sapphire cladding) in the photonic crystal fibers that have cladding holes of different sizes and/or non-periodic structures.

The bundle 30 can be provided with a protective layer or jacket 80 that surrounds the photonic crystal fibers 20. The jacket 80 can extend over all or a portion of the bundle 30, and can also be multiple jackets along a length of the bundle. The jacket 80 can provide thermal protection through use of various materials having low thermal conductivity, while maintaining the flexibility of the photonic crystal fibers 20 so that the bundle 30 can be easily manipulated into various environments. The jacket 80 can also include material that provides strength to the photonic crystal fibers 20 to prevent tearing or other damage. The jacket 80 can assist in holding the photonic crystal fibers 20 together in the desired configuration of the bundle 30. However, the present disclosure contemplates other structures and techniques for arranging or bundling the photonic crystal fibers 20 into bundle 30, such as, for example, a high temperature adhesive.

In operation, when the monitoring system 10 is initiated, the imaging camera 50 can detect the light captured at imaging end 32 of each of the photonic crystal fibers 20 and guided through the bundle 30. The image can be converted to a digital signal and transmitted to a processing device or system 60. The processing system 60 can interpret and process the transmitted image. The processed image is preferably output in a form that can be suitably visually displayed. For example, a visual outputting device, such as a computer monitor 75, can allow the data to be displayed in a real time fashion. The data can also be stored separately and used with a suitable program or database for subsequent analysis. The image output from system 10 can be used and compared to other image outputs to determine trends in the gas turbines or other environments being monitored. The image output can have various other uses and applications. Various processing systems, software and the like can be used for generating the image from the light captured by bundle 30.

Figure 4:
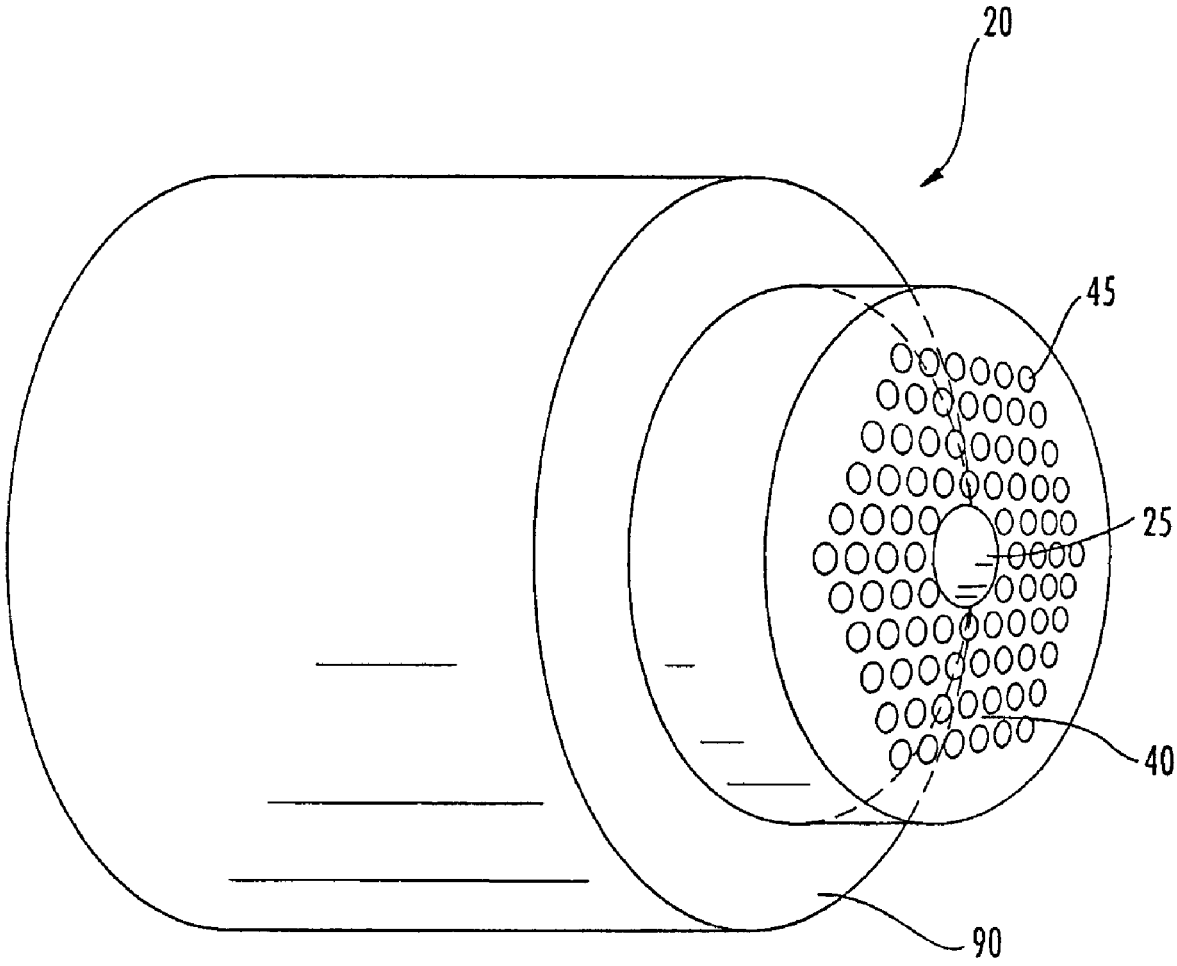
FIG. 4 is a perspective, cross-sectional view of another exemplary embodiment of a photonic crystal fiber in accordance with the invention.

Referring to FIG. 4, the photonic crystal fiber 20 can be provided with a protective layer 90 that surrounds the glass cladding 40 (e.g., sapphire) and hollow core 25. The protective layer 90 can provide thermal protection through use of various materials having low thermal conductivity, while maintaining the flexibility of the photonic crystal fiber 20 so that the bundle 30 can be easily manipulated into various environments. The protective layer 90 can include material that provides strength to the photonic crystal fibers 20 to prevent tearing or other damage. Various other protective layers can also be used over some or all of the photonic crystal fibers 20, such as a dielectric protective coating.

Figure 5:
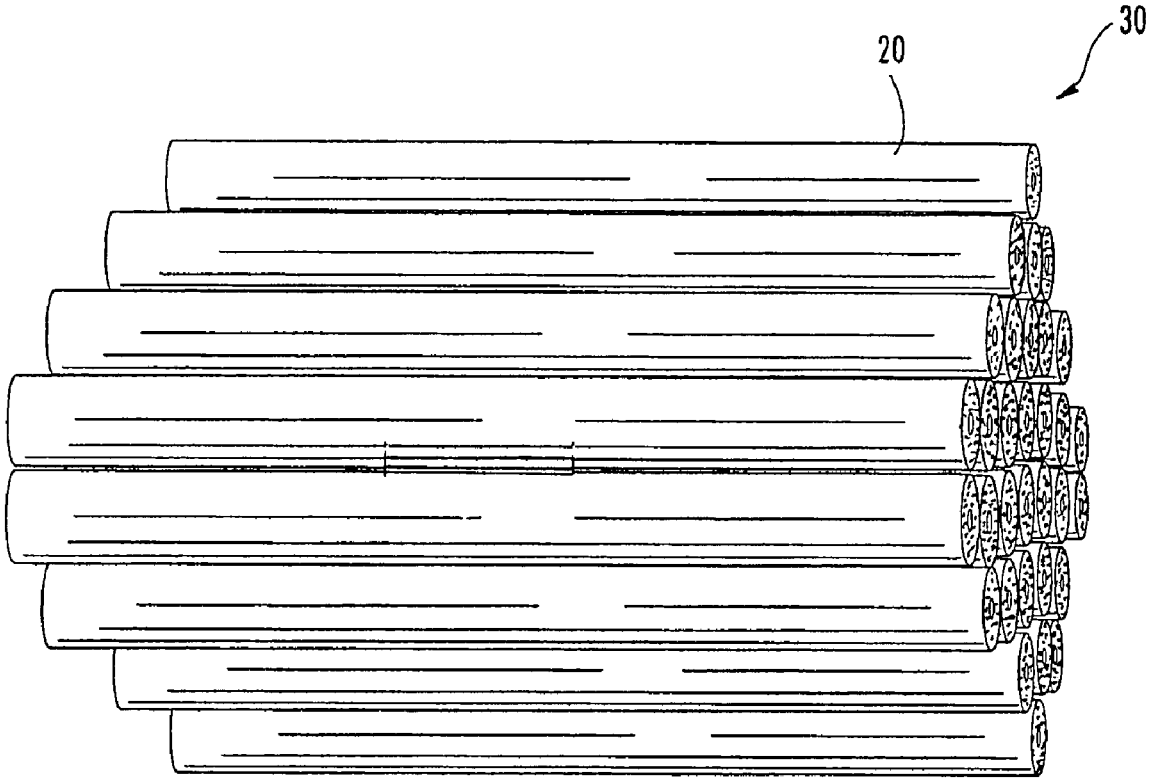
FIG. 5 is a perspective view of an exemplary embodiment of a linear bundle of photonic crystal fibers in accordance with the invention.

Referring to FIG. 5, another exemplary embodiment of bundle 30 is shown with photonic crystal fibers 20 that can be arranged in an array. The array can be a close-packed configuration such as a rectangular array (shown) or another type of array such as a honeycomb array where consecutive rows are off-set from each other to minimize the spaces formed between the photonic crystal fibers 20. The use of the array configuration of each of the photonic crystal fibers 20 can be used for capturing an image of a larger area of interest. The present disclosure contemplates the use of other configurations for the bundle 30 including other close-packed configurations or loose-packed configurations, as well as combinations thereof.

Figure 6:
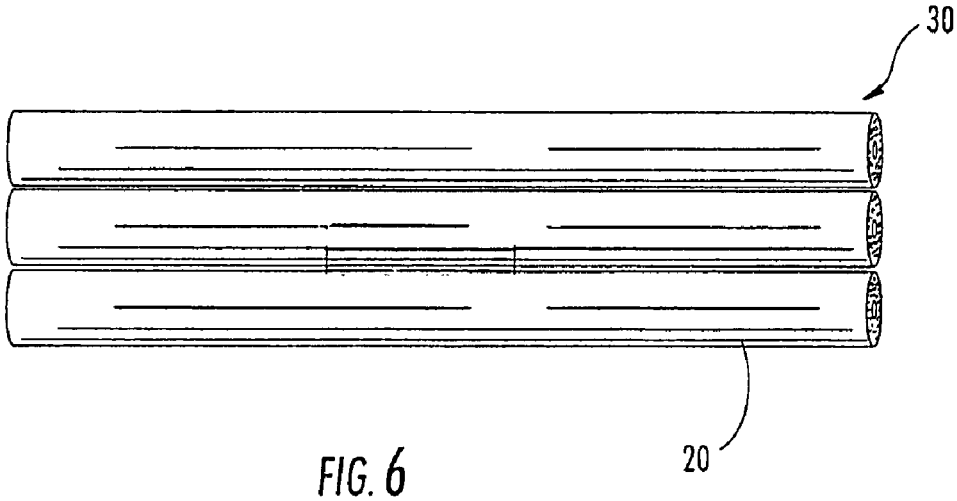
FIG. 6 is a perspective view of an exemplary embodiment of an array bundle of photonic crystal fibers in accordance with the invention.

Referring to FIG. 6, another exemplary embodiment of bundle 30 is shown with photonic crystal fibers 20 that can be arranged linearly. The use of a linear configuration for each of the photonic crystal fibers 20 can be used where the area of interest for imaging is along a line.

Figure 7:
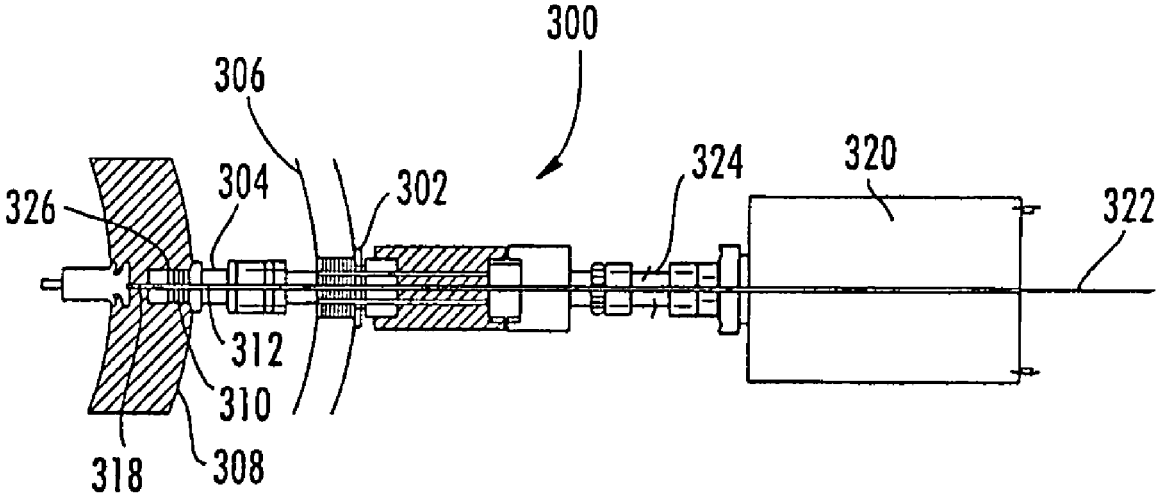
FIG. 7 is a cross-sectional view of another exemplary embodiment of a monitoring system in accordance with the invention.

Referring to FIG. 7, another exemplary embodiment of a monitoring system 300 is shown, which can be formed from an insertion probe 302 configured to house at least a portion of a fiber optic head assembly 304. The insertion probe 302, in at least one embodiment, can be configured to be attached to a turbine engine or other high temperature machine or environment 306, such as a vane carrier 308 of the turbine engine. The insertion probe 302 can provide access for the monitoring system 300 to an airfoil during operation of the turbine engine 306. The insertion probe 302 can be positioned proximate to any of the components of the turbine engine 306 that are subjected to high temperatures and thus are difficult to monitor. The insertion probe 302 can be configured to be releasably attached to the machine 306. In one embodiment, the insertion probe 302 can be attached to the machine 306 with threads.

The fiber optic head assembly 304 can be formed from a housing 310 and a fiber optic bundle 312 formed by a plurality of photonic crystal fibers 20 (shown in FIGS. 2 and 3) having cladding 40 that surrounds and defines the hollow core 25. The cladding 40 can be a sapphire which has a high operating temperature of typically greater than 1200° C. The hollow core 25 can be filled with air. The hollow core 25 can be a waveguide that transmits infrared wavelengths, e.g., 3-12 μm, along the fiber optic bundle 312. The sapphire cladding 40 can surround and protect the hollow core waveguide 40 against the extreme temperatures in the gas turbine, while allowing for imaging of the gas turbine components during operational loads.

The fiber optic head assembly 304 can be releasably connected to the insertion probe 302. A lead screw 326 or other appropriate device can be positioned within the insertion probe 302 for moving the fiber optic head assembly 304 within the insertion probe 302. The fiber optic head assembly 304 can include a fiber optic probe tip 318 formed from the plurality of photonic crystal fibers 20. The fiber optic probe tip 318 can be formed from various configurations.

A drive device 320 can be included for moving the fiber optic head assembly 304 relative to the insertion probe 302. In one embodiment, the drive device 320 can be configured to move the fiber optic head assembly 304 generally parallel to a longitudinal axis 322 of the insertion probe 302. The drive device 320 can be, but is not limited to being, a stepper motor, a pulsed DC motor with planetary reduction gears, or other appropriate drive mechanism. The drive device 320 can also be coupled to a threaded shaft 324 for moving the fiber optic head assembly 304 relative to the insertion probe 302.

The fiber optic head assembly 304 can be secured to the insertion probe 302 such that the drive device 320 controls translation movement of the fiber optic head assembly 304 along the longitudinal axis 322 so as to locate the fiber optic probe tip 318 at the desired location. The fiber optic head assembly 304 can be coupled to the insertion probe 302 such that as the fiber optic head assembly 304 is moved relative to a surface to be measured, the fiber optic head assembly 304 does not rotate.

While specific embodiments of the invention have been described in detail, it will be appreciated by those skilled in the art that various modifications and alternatives to those details in structure, composition and/or processes could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

I claim:

1. A system for monitoring an area of interest in a gas turbine, the system comprising:

at least one photonic crystal fiber having an imaging end and a processing end, the at least one photonic crystal fiber comprising a sapphire cladding and defining a hollow core;

an imaging camera operably connected to the processing end of the at least one photonic crystal fiber; and an imaging processor operably connected to the imaging camera, wherein the imaging end of the at least one photonic crystal fiber captures light in the area of interest and guides the light to the imaging camera, and wherein the imaging processor generates an image based on the light.

2. The system of claim 1, wherein the at least one photonic crystal fiber is a plurality of photonic crystal fibers arranged in a bundle.

3. The system of claim 2, wherein the bundle is arranged linearly or in an array.

4. The system of claim 1, wherein the light has a wavelength between 3 to 12 μm.

5. The system of claim 1, wherein the at least one photonic crystal fiber is chosen from the group consisting essentially of a photonic crystal band gap fiber, photonic crystal holey fibers, photonic crystal hole-assisted fibers, photonic crystal Bragg fibers, and combinations thereof.

6. The system of claim 1, wherein the sapphire cladding comprises a lattice of sapphire capillaries having a period of 5 μm.

7. The system of claim 6, wherein the hollow core has a diameter of 13 μm.

8. The system of claim 7, wherein the at least one photonic crystal fiber has a protective coating thereon.

9. The system of claim 1, wherein the imaging camera is a focal plane array imager.

10. A monitoring system for an environment having an elevated temperature, the system comprising:

a bundle of photonic crystal fibers having an imaging end and a processing end, each of the photonic crystal fibers having a cladding comprising a lattice of sapphire capillaries;

an imaging camera operably connected to the processing end of the bundle of photonic crystal fibers; and an imaging processor operably connected to the imaging camera, wherein the lattice of sapphire capillaries have a microstructure that allows the photonic crystal fibers to capture light with a wavelength of between 3 to 12 μm, wherein the photonic crystal fibers guide the light to the imaging camera, and wherein the imaging processor generates an image based on the light.

11. The monitoring system of claim 10, wherein the lattice of sapphire capillaries define a hollow core of the photonic crystal fibers.

12. The monitoring system of claim 10, wherein the photonic crystal fibers have a protective coating thereon.

13. The monitoring system of claim 10, wherein the imaging camera is a focal plane array imager.

14. A method of monitoring a gas turbine comprising:

providing at least one photonic crystal fiber having a hollow core, an imaging end and a processing end;

positioning the imaging end in proximity to an area of interest of the gas turbine;

operably connecting the processing end to an imaging camera;

capturing light with the imaging end;

guiding the light through the at least one photonic crystal fiber to the imaging camera; and converting the light into an image with an image processor, further comprising forming the at least one photonic crystal fiber from a sapphire cladding.

15. The method of claim 14, further comprising forming the at least one photonic crystal fiber from a microstructure lattice of sapphire capillaries, wherein the microstructure lattice has a period that allows for capturing of the light with a wavelength of between 3 to 12 μm.

16. The method of claim 14 wherein the sapphire cladding comprises a lattice of sapphire capillaries having a period of 5 μm and a hollow core with a diameter of 13 μm.

17. The method of claim 14, wherein the at least one photonic crystal fiber is a plurality of photonic crystal fibers arranged in a bundle.

18. The method of claim 17, wherein the bundle is arranged in an array or linearly.

19. The method of claim 14, wherein the at least one photonic crystal fiber is chosen from the group consisting essentially of a photonic crystal band gap fiber, photonic crystal holey fibers, photonic crystal hole-assisted fibers, photonic crystal Bragg fibers and combinations thereof.

* * * * *